United States Patent [19]

Bailey et al.

[11] Patent Number: 4,734,691

[45] Date of Patent: Mar. 29, 1988

[54] VIDEO BIT TRANSITION ADVANCEMENT CIRCUIT

[75] Inventors: Geoffrey A. Bailey, Winchester; Milan H. Miessler, Ampfield, both of England

[73] Assignee: International Business Machines Corporation, Armonk, N.Y.

[21] Appl. No.: 826,692

[22] Filed: Feb. 6, 1986

[30] Foreign Application Priority Data

Mar. 4, 1985 [EP] European Pat. Off. ..... 85301482.7

[51] Int. Cl.[4] ..... G09G 1/16

[52] U.S. Cl. ..... 340/744; 340/805; 340/812

[58] Field of Search ..... 340/793, 744, 805, 811, 340/812, 813, 723, 728, 814; 315/383, 384, 385

[56] References Cited

U.S. PATENT DOCUMENTS 4,604,614 8/1986 Farr et al. ..... 340/744

FOREIGN PATENT DOCUMENTS 0069994 1/1983 European Pat. Off. ..... 340/744
0104289 4/1984 European Pat. Off. .

OTHER PUBLICATIONS

IBM Technical Disclosure Bulletin, vol. 17, No. 11, Apr. 1975, pp. 3325–3327, M. H. Nasser et al.; "Correction of Phase Distortion in a Television Receiver when used for Character Display Purposes".

*Primary Examiner*—Gerald L. Brigance
*Attorney, Agent, or Firm*—J. Dennis Moore

[57] ABSTRACT

In order to compensate for image distortion introduced into a digitally controlled raster-scan CRT by the finite video amplifier rise and fall times, the digital video drive waveform is subjected to selective pulse stretching to extend the duration of each pel which is immediately preceded by a pel of lower light intensity value (brightness). This is achieved by means of a comparator (14) which examines each current pel PEL(N) in the video data stream in relation to its immediately preceding neighbor PEL(N-1) in order to detect pel boundary transition therebetween representing an increase in brightness from the preceding pel to the current pel. Re-timing means (17, 19, 21, 22) is operably under control of the comparator output to cause advancement in time by a predetermined amount (dt) of any such pel boundary transition relative to remaining pel boundary transitions.

7 Claims, 7 Drawing Figures

17
15
21
33
37
38
39
16
11
34·1
34·3
34·(x-1)
35·x
SELECT(dtx)
34·2
19
SELECT(dt3)
36
35·3
SELECT(dt2)
35·2
SELECT(dt1)
35·1

VIDEO BIT TRANSITION ADVANCEMENT CIRCUIT

BACKGROUND OF THE INVENTION

1. Field of the Invention

This invention relates to a video display system of the kind in which at least one visible characteristic of consecutive image points on the screen of a raster-scan CRT is defined by the values of consecutive pels of a digital video drive waveform, each such pel comprising one or a plurality of video bits in parallel, and in which a pulse stretching circuit is provided for extending the duration of selected pels in the video waveform in order at least partially to compensate for image distortion introduced by the finite video amplifier rise and fall times of the CRT. One system of this kind is described in IBM TDB, Vol. 24, No. 11B, page 5794 and is used in the IBM 8775 terminal, another is described and claimed in the European patent application No. 0104289.

2. Background Art

The video channel of a high content raster-scan CRT display must operate at a very fast data rate if flicker is to be avoided. For example, a data display having 1.2 million image points refreshed at 60 Hz with a non-interlaced raster requires a peak data rate of about 100 Mpels/Sec. This corresponds to a pel period of 10 nSecs. Full modulation of the electron beam requires a cathode drive voltage of about 35 volts for a monochrome tube and up to 60 Volts for color. It is very difficult to design a video amplifier to product these voltage transitions in a time which is short compared to the pel period. This is particularly true if the amplifier must handle analogue signals rather than a simple binary waveform. In this case 10 to 90% rise and fall times of 7 nSecs are considered state-of-the-art for a color display. Such an amplifier will product greatly distorted video pulses compared to the ideal rectangular shape. For the user the effect is particularly noticeable on vertical strokes which have much reduced contrast if they are only one image point wide. The problem is most severe with a monochrome bright-on-dark display (hereinafter referred to as a white-on-black display for convenience) because the beam current is proportional to the drive voltage raised to a power gamma, where gamma is typically 2.2. consequently, the contrast of a single image point is effectively related to the drive pulse width measured near the voltage for peak white and this is only a few nSecs for a white pulse with the figures quoted.

One known solution to this problem, used in white-on-black displays and described in the above referenced IBM TDB is to extend the trailing edges of positive (white) pels by logically OR'ing the video waveform with a delayed version of itself. Obviously this technique lengthens positive pels by shortening negative ones and as such as unsuitable for displays having mixed white-on-black and black-on-white information. This problem can be overcome in the restricted case when all the information in a particular region of the display screen is known by the system to have the same polarity. In this case the video signal can be inverted before and after the basic pulse stretching circuit by two exclusive OR gates fed with a signal indicating the information polarity.

In order to cope with mixed polarity displays of high density the system itself must have knowledge of the polarity of the display in each region of the screen. Even where the polarity is known, a highly dense display would have a significant number of image points of opposite polarity to the main information which are isolated in the raster scan direction, and such points would inevitably be reduced in width by the automatic delay of the trailing edge of the immediately preceding pel. Also, the technique cannot be extended to displays with several bits per pel.

An improved display system of the above kind which overcomes these drawbacks is described in an aforementioned European patent application. Here the pulse stretching circuit comprises decoding means for examining each pel at least in relation to its two immediate neighbors on either side in order to detect predetermined relationships between the values of the pels, and retiming means for selectively advancing or delaying the transitions between consecutive pels of different value in accordance with the relationships so detected. The advantage of this system over that described in the TDB article is that pels are selected for extension only as a function of their relationship to neighboring pels, so that isolated pels of substantially different color and/or intensity to their neighbors can be identified, at least maintained at their nominal width, and where possible increased in width.

Although the system described in the aforesaid European patent application provides substantially improved visual results for highly dense or mixed video pictures, and considerably enhances the front-of-screen performance of the display system compared to the existing technique, the penalty for this improved performance is one of cost in the additional circuitry involved. Thus, even in the simple case where only the relationship of each pel to its two immediate neighbors on either side is examined, the preferred circuitry includes a 5 stage shift register; a multi-bit comparator; a 3-stage shift register with associated output logic; and 3 clocking latches also with associated output logic. As explained, the system is not restricted to this simple case and by providing more complex circuits at further cost it is possible to compensate for image distortions in both color and monochrome to an increased degree of sophistication.

As previously stated hereinbefore, it has been observed that the problem of image distortion is most severe in the case of a white-on-black display. Thus, whereas a single pel wide vertical white line on a black background virtually disappears, a single pel wide vertical black line on a white background is clearly visible. As a result of an analysis of the reasons for the distortion, a new solution to the problem has been devised which not only has the advantage over the previous solutions of being applicable to bi-level (black and white) high resolution displays and to an image display with a number of 'grey' levels in monochrome or in color but also is of relatively low cost. In addition to the saving of circuitry, the present solution is believed to provide a more accurate correction than that afforded by previous methods.

The analysis of the problem will now be given with reference to FIGS. 1 to 3 of the accompanying drawings. FIG. 1 shows the relationship between the grid (or cathode) voltage $V_d$ and beam current $I_b$ in a cathode ray tube display. Beam current is linearly related to the resultant luminance of the screen phosphors. The relationship between the applied grid voltage $V_d$ and beam current $I_b$ is given by the expression:

$$I_b = \kappa . Vu_{gamma},$$

where $\kappa$ and gamma are constants

In FIG. 1 two relationships are shown, continuous curve 1 for the case where the gamma value is 1 and broken curve 2 where the gamma value is 3. In practice, in order to compensate for the non-linearity of the response of the human eye, a CRT with a gamma value of 2.2 is probably ideal.

Two curves illustrating the relationship of grid voltage to beam current of the video amplifier are shown in FIG. 2 in response to the rising and falling edges of a single bit of a video signal bi-level waveform 3 such as might be applied as input to a CRT grid electrode. An input step function $V_{in}$ applied to a CRT grid electrode is shown as waveform 3. The resulting grid voltage $V_d$ is shown as continuous waveform 4. It might be expected that the resultant beam current would follow the grid voltage faithfully. The continuous curve 4 represents the theoretical response of the amplifier. However, in view of the non-linear relationship between grid voltage and beam current in practice, with a CRT gamma of 3, the beam current $I_b$ and hence the light emission is more likely to be as represented by the broken curve 5. The waveforms 3, 4 and 5 are all shown on the same time scale in FIG. 2. It is seen therefore that the rise time of an input pulse is made effectively longer while the fall time is made shorter. Furthermore, the amplitude of the effective video amplifier pulse never reaches its intended full magnitude represented by the magnitude of the bi-level input signal waveform 3 and the displayed pel on the screen never reaches full brightness.

In FIG. 3 two portions of a bi-level input waveform leading to opposite conditions on the screen are shown. The first, waveform portion 6, shows the signal applied to a video amplifier in order to display a single white or 'on-pel' on each side of which is a black or 'off-pel'. The second, waveform portion 7, shows the signal required in order to display the condition where a black or 'off-pel' is sandwiched between two white or 'on-pels'. Superimposed on these two input waveform portions in FIG. 3 are the effective resulting video amplifier output waveforms shown as continuous curves 8 and 9 respectively, which actually drive the video guns of the CRT.

Thus in the case where the portion 6 of the input pulse waveform calls for the display of a single white pel sandwiched between black pels, the resultant video output pulse 8 is distorted as described hereinbefore with reference to FIG. 2. that is, it is shorter in duration than the input waveform that drives it and does not reach its intended full magnitude. Accordingly, the resulting white pel is narrower and of lower intensity than desired.

In the case where the input pulse waveform 7 calls for the display of a single black pel sandwiched between white pels, the response to the rising and falling edges of the input pulse by the video amplifier is just the same, but because of the inverted input pulse condition, produces a different effect. As shown in the figure, the video output pulse falls fairly rapidly in response to the trailing edge of the input pulse but is relatively slow to respond to the subsequent rising edge. The effect of this is to cause the video output to be at its down level for a longer period than that called for by the input pulse. Consequently, the width of the resulting black pel is wider than required. This increase of width of the black pel is not so noticeable to a viewer of the CRT screen as the reduction in width and intensity of a white pel.

With multi-grey level waveforms the effect of the non-linearity on the amount of emitted light is substantial. The differences between shades are compressed in the darker grey shades and expanded in the lighter grey shades. It is therefore highly desirable not only to mitigate the delaying effect on white edges but also on all transitions from darker to lighter shades of grey. There is no need to provide any correction for black edges or for transitions from lighter to darker shades of grey.

The above analysis of the problem has shown that the effect of gamma on the fall time of the video amplifier output is beneficial in the way that the resulting waveform resembles the ideal rectangular edge closer than that of the raw output from the video amplifier. As a consequence, the CRT beam current and thereby the CRT luminance decrease quicker. On the other hand, the effect of the slowed down rise-time is severe. The additional delay in the typical case for a gamma of 3.5 and pulse video amplifier rise time of 2 ns is about 1.5 ns and is the same for all steps in the video signal representing dark to light transitions on the screen.

SUMMARY OF THE INVENTION

The solution to the problem therefore is to arrange for the relative advancement of the rising edges only, of the input pel waveform by predetermined amounts in order to compensate for the experienced signal delays occasioned by the particular apparatus in question. In the general case such a rising edge will occur whenever a lighter pel follows a darker pel and in the specific case whenever a white pel follows a black pel. Thus in FIG. 3, the rising leading edge of the positive going portion of the input waveform 6 is shown advanced in time as broken outline 6', and the rising trailing edge of the negative going portion of the input waveform 7 is shown advanced as broken outline 7'. The resulting corrected video amplifier output waveforms 8 and 9 are shown in broken outline as curves 8' and 9' respectively. The effect of this time shift of the rising edges of the input waveform is in each case to provide an amplifier output waveform which more closely follows the original uncorrected input waveform.

Clearly, the same effect is obtainable by delaying the trailing edges of the input waveform. The important requirement is that positive waveform portions such as that illustrated by waveform 6 representing a white picture element (pel) on a black background are lengthened in time whereas negative going portions such as that illustrated by waveform 7 representing a black pel on a white background are shortened in time.

In order that that invention may be fully understood, a preferred embodiment thereof will now be described with reference to the accompanying drawings. In the drawings.

DETAILED DESCRIPTION OF THE PREFERRED EMBODIMENT

Figure 1:
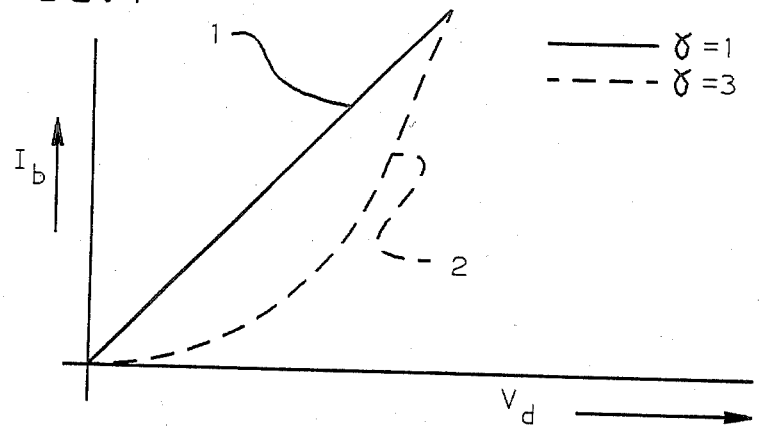
FIG. 1 shows the relationship between grid voltage $V_d$ and beam current $I_b$ in a cathode ray tube display.
Figure 2:
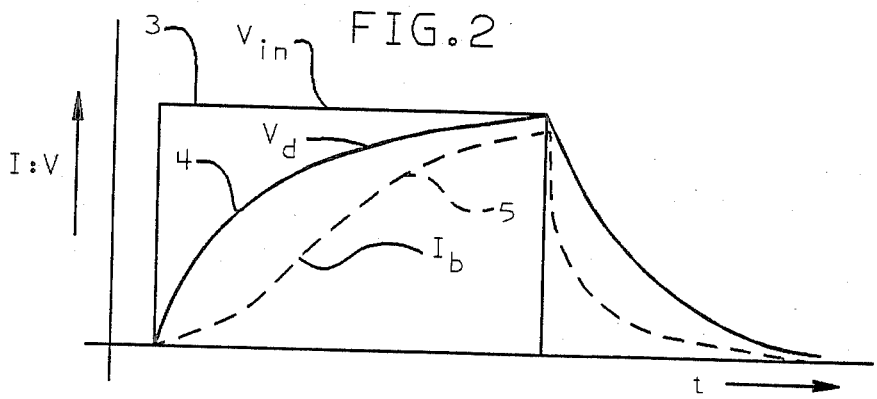
FIG. 2 shows the relationship between a grid voltage waveform and a beam current waveform for a single bit in a cathode ray tube display.
Figure 3:
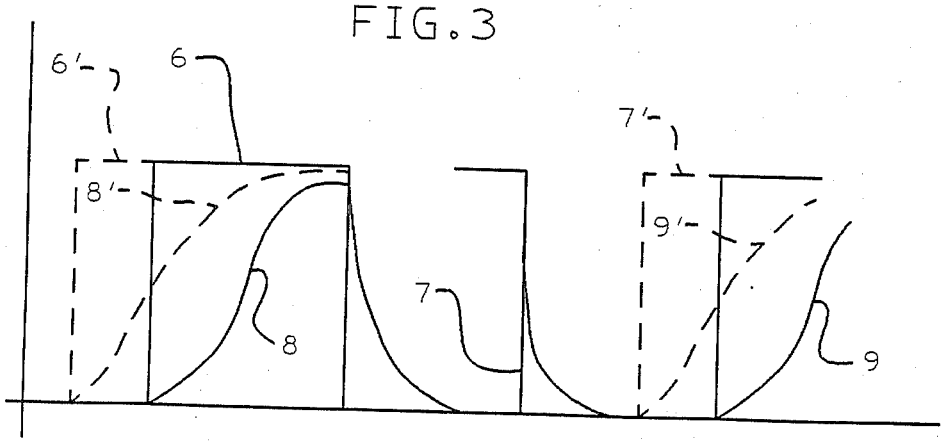
FIG. 3 shows two portions of a bi-level input grid voltage waveform superimposed on the resultant beam current waveform.

FIGS. 1–3 have been discussed above, in connection with the background art.

Figure 4:
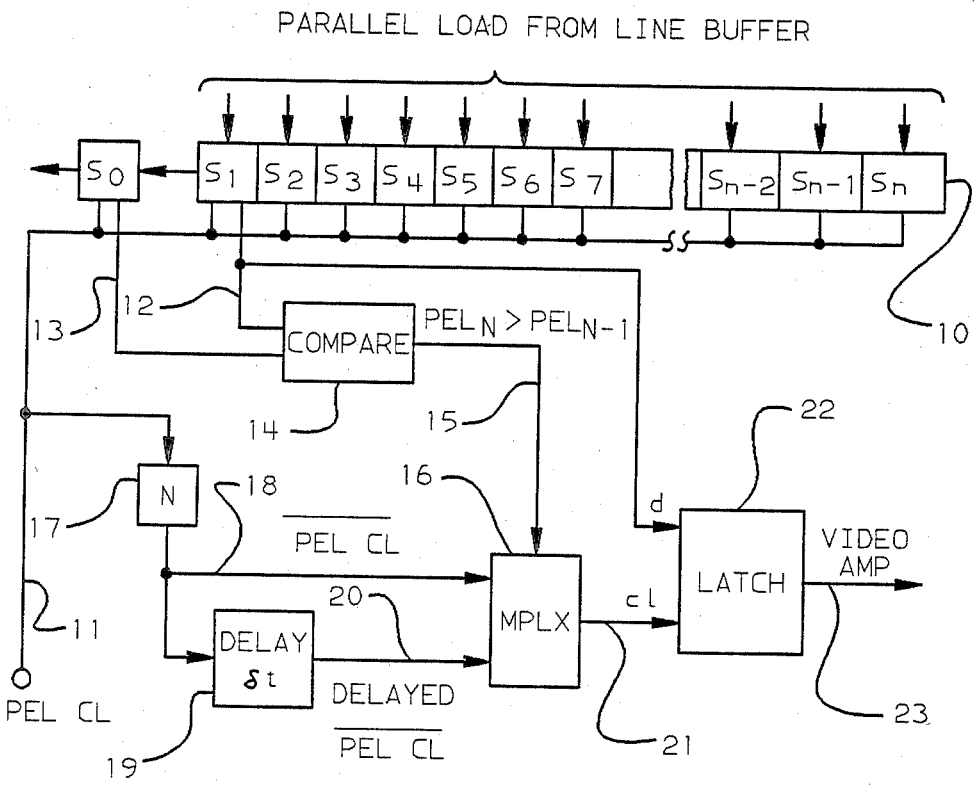
FIG. 4 shows a block diagram of a pulse stretching circuit in accordance with the present invention.

For the sake of simplicity, the embodiment shown in FIG. 4 is for implementation in a monochrome bi-level, e.g. white-on-black, display system. However, as stated hereinbefore and as will be apparent from the expanded circuit of FIG. 6, the invention is equally applicable to monochrome or color displays capable of displaying multiple brightness levels in grey or color.

The manner in which a digital video waveform is used to drive a raster-scan CRT is well known in the computer graphics art and may be found in many textbooks on the subject and also in commercially available products such as the aforementioned IBM 8775 terminal. It is, therefore, not thought necessary to provide details of this aspect of the display system but rather to concentrate on the pulse stretching circuit wherein the present invention lies.

Accordingly, as shown in FIG. 4, each individual n-bit line of data for display on the CRT is conventionally loaded in parallel from the system display buffer (not shown) into an n-bit shift register 10 having stages S1 to Sn. It has been assumed for the purpose of illustration, that as a result of the loading operation, the eight left-most stages of the register S1, S2, . . . of the shift register 10 containing the first eight pels for display on the CRT scan line have the binary values 0, 1, 0, 0, 1, 1, 0, 1. It is seen that this portion of the pel data, shown as waveform (a) in FIG. 5, includes a white pel (binary 1) between two black pels (binary 0) and a black pel between two white pels.

The contents of the shift register are incrementally clocked one stage at a time from right to left, as shown in the figure, by means of predetermined transitions of a pel clock waveform applied to terminal 11. In this embodiment, the clocking is in response to the rising edges of the pel clock waveform. The pel clock waveform is shown as waveform (b) in FIG. 5. Normally, the binary values representing the pels to be displayed on the screen are sampled from the left-most stage S1 of register 10, each pel clock cycle. The resulting pel binary waveform, such as waveform (a), is then used to drive the video amplifier in order to effect the display on the screen.

In accordance with the present invention, however, in order to compensate for image distortion, the video waveform is modified by advancing relative in time, those rising edges of the binary waveform which occur when the lighter pel follows darker pel or, as in this specific implementation, when a white pel follows a black pel. Briefly, this is achieved simply by using a delayed version of the pel clock to gate the pel waveform to the video amplifier except when a black-to-white (or dark to lighter) transition occurs, in which case the clocking of the pel value immediately following the transition is by means of the undelayed pel clock. The transitions which occur between adjacent pels of different intensity are detected by comparing their binary values. This is achieved by means of an additional stage S0 connected to the output from stage S1 of shift register 10. The stage S0 is clocked by the same pel clock as the register so that each pel value clocked through stage S1 is contained in the extra stage S0 one clock period later. In other words, if stage S1 is regarded as containing PEL(N) then at that time extra stage S0 contains PEL(N−1).

Output lines 12 and 13 from stages S1 and S0 respectively are connected as inputs to a comparator 14 which continuously compares the binary values of the two adjacent pels contained therein. The output on line 15 from comparator 14 is at an up-level for the condition PEL(N)>PEL(N−1). That is, a rising output on line 15 indicates the current pel, PEL(N) in stage S1, is brighter than the preceding pel, PEL(N−1), in stage S0, (in this example a white pel following a black pel). Accordingly, the rising edge of the pel waveform representing this increase in brightness is required to be advanced relative in time as explained hereinbefore.

Inspection of the input pel data in waveform (a) reveals that there are three instances where a white pel follows a black pel. The comparator output is high as a consequence for the duration of the pel clock cycle (small circuit delays ignored) following each detected intensity increase. The comparator output in response to the pel data in waveform (a) is shown as waveform (c). The selections of clock pulses or transitions from the normal clock cycle or from the delayed clock cycle is made by means of a multiplexor 16 under control of the comparator output waveform (c) on line 15 which performs the selection. Since the comparison of pel values by comparator 14 is a continuous operation, the output signal on line 15 remains good for substantially one clock cycle following the incidence of the transition from darker pel to lighter pel. It is during this period that a re-timed clock pulse or clock transition is generated and which is ultimately used to gate the corresponding pel value to the video amplifier.

Figure 5:
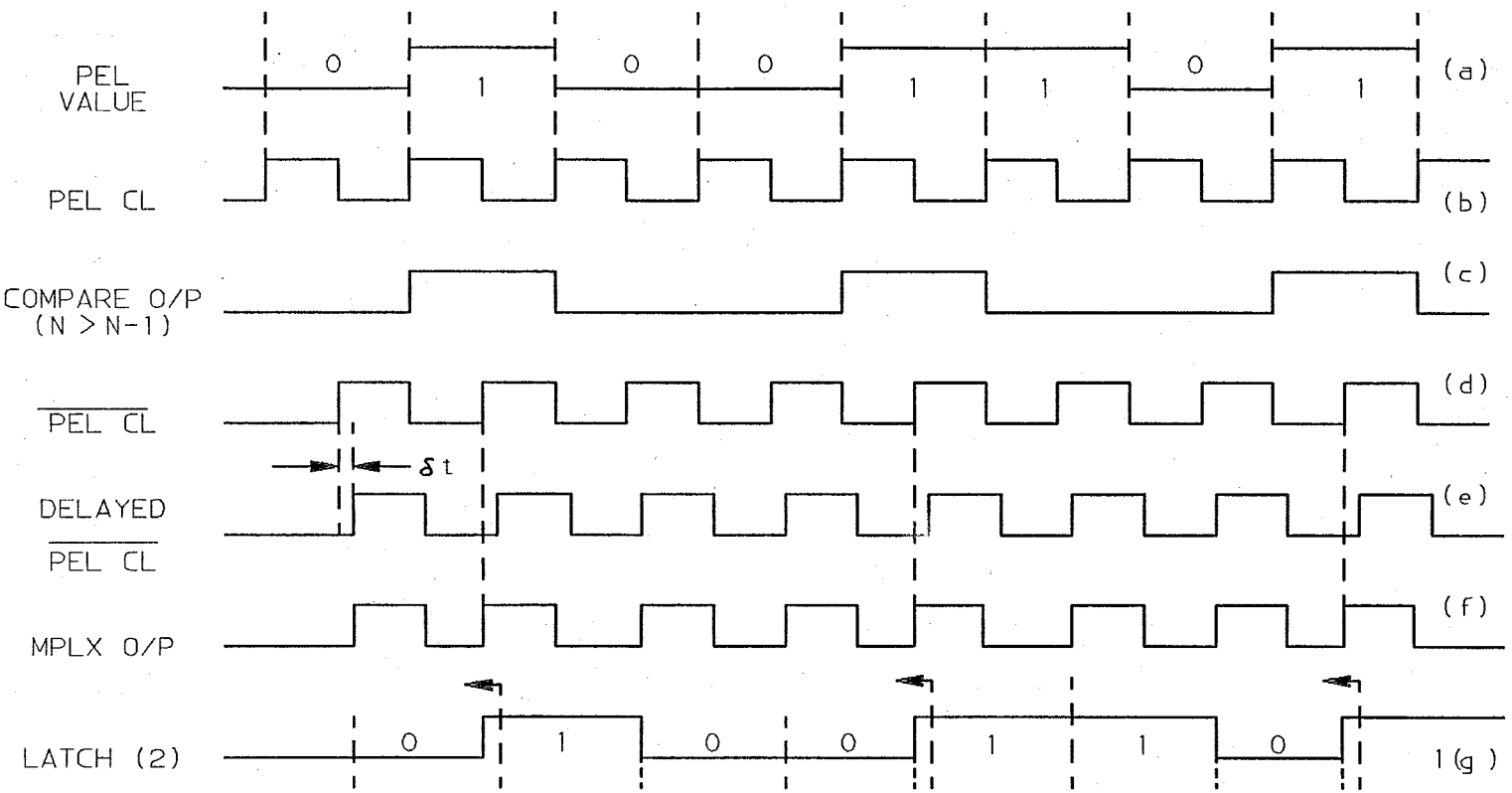
FIG. 5 shows waveforms used to illustrate the mode of operation of the circuit FIG. 4.

A copy of the clock waveform with the clocking transitions occurring mid-way through the pel clock cycle is achieved by passing the pel clock waveform from terminal 11 through a suitable phase shift circuit 17. Since in this embodiment, the pel clock waveform is symmetrical, a ½-pel cycle phase shift is most readily achieved by simple inversion. The copy of the pel clock waveform phase shifted by ½-pel clock cycle is shown as waveform (d) in FIG. 5 is identified as (PEL CL). This phase-shifted copy of the original pel clock is applied over line 18 as one input to multiplexor 16. In addition, the ½-pel phase-shifted copy of the original pel clock is applied over line 18 as one input to multiplexor 16. In addition, the ½-pel phase-shifted the clock waveform is itself separately passed through delay circuit 19 in order to impart an additional small phase shift equal to a predetermined delay (dt). The additionally delayed phase shifted clock waveform is shown as waveform (e) in FIG. 5 and is identified as (DELAYED PEL CL). This delayed copy of the clock waveform is applied over line 20 as a second input to multiplexor 16. The arrangement is such that when the output from the compare circuit is high, a clock transition from the undelayed copy of the shifted pel clock (PEL CL) is gated to the output of the multiplexor and when the output is low, a clock transition from the additionally delayed copy of the shifted pel clock (DELAYED PEL CL) is gated to the output of the multiplexor. The resultant pel clock waveform with re-timed or corrected transitions appearing on line 21 from the output of the multiplexor, is shown as waveform (f) in FIG. 5. From this it is seen that three of the clock transitions in the waveform coincide with corresponding transitions in the ½-pel phase shifted clock of waveform (d) whereas the remaining clock transitions in the waveform coincide with corresponding transitions in the delayed version of this clock of waveform (e).

Since at the time when a clocking transition of the re-timed clock occurs (early or late as a consequence of the relative values of the current pel and its predecessor) the current pel under investigation is still available for interrogation in shift register stage S1, its value can be sampled by means of the associated clocking transition which as a result of ½-pel cycle phase shifting now occurs substantially at the center of the original pel clock cycle. The output from the current stage S1 of the shift register 10 available on line 12 is therefore continuously supplied to the data input of latch 22. The re-timed output pel clock waveform on line 21 is applied to the clock input of latch 22. The pel values supplied successively to data input of the latch are gated to its output line 23 under timing control of the re-timed clock transitions of the clock waveform from the multiplexor 16. The resultant selectively stretched pel data waveform with the three black-to-white transitions advanced relative to the remaining waveform transitions by the small time predetermined interval (dt) is shown as waveform (g) in FIG. 5.

Extension of the circuitry in accordance with the invention for use in a system displaying multiple brightness levels in grey or color is achieved largely by duplication of components in FIG. 4 as many times as necessary and will now be described with reference to FIG. 6. Thus, for a system with 8-levels of grey in which the intensity value of each pel is represented by a 3 bit binary number, three shift registers 10.1, 10.2, 10.3, each identical to shift register 10 of FIG. 4, and three extra stages S0.1, S0.2, S0.3, each connected to its respective shift register output S1.1, S1.2, S1.3, are provided to clock the 3-bit pel values. The compare circuit 14 is expanded so that instead of being a simple bi-level comparator it is operable to compare two 3-bit values each pel period and to provide an output signal having an up-level each time the intensity value of the current pel exceeds that of the preceding pel. This binary output signal from the comparator is used to select, by means of the multiplexor gating circuit 16, clocking transitions from either the nominal ½-pel cycle phase shifted clock or clocking transitions from the additionally delayed clock. This in turn is used to gate the bit values representing the current pel intensity from the three corresponding stages of the three shift registers through three associated latches 22.1, 22.2, and 22.3 so as to drive the video amplifier.

Figure 6A:
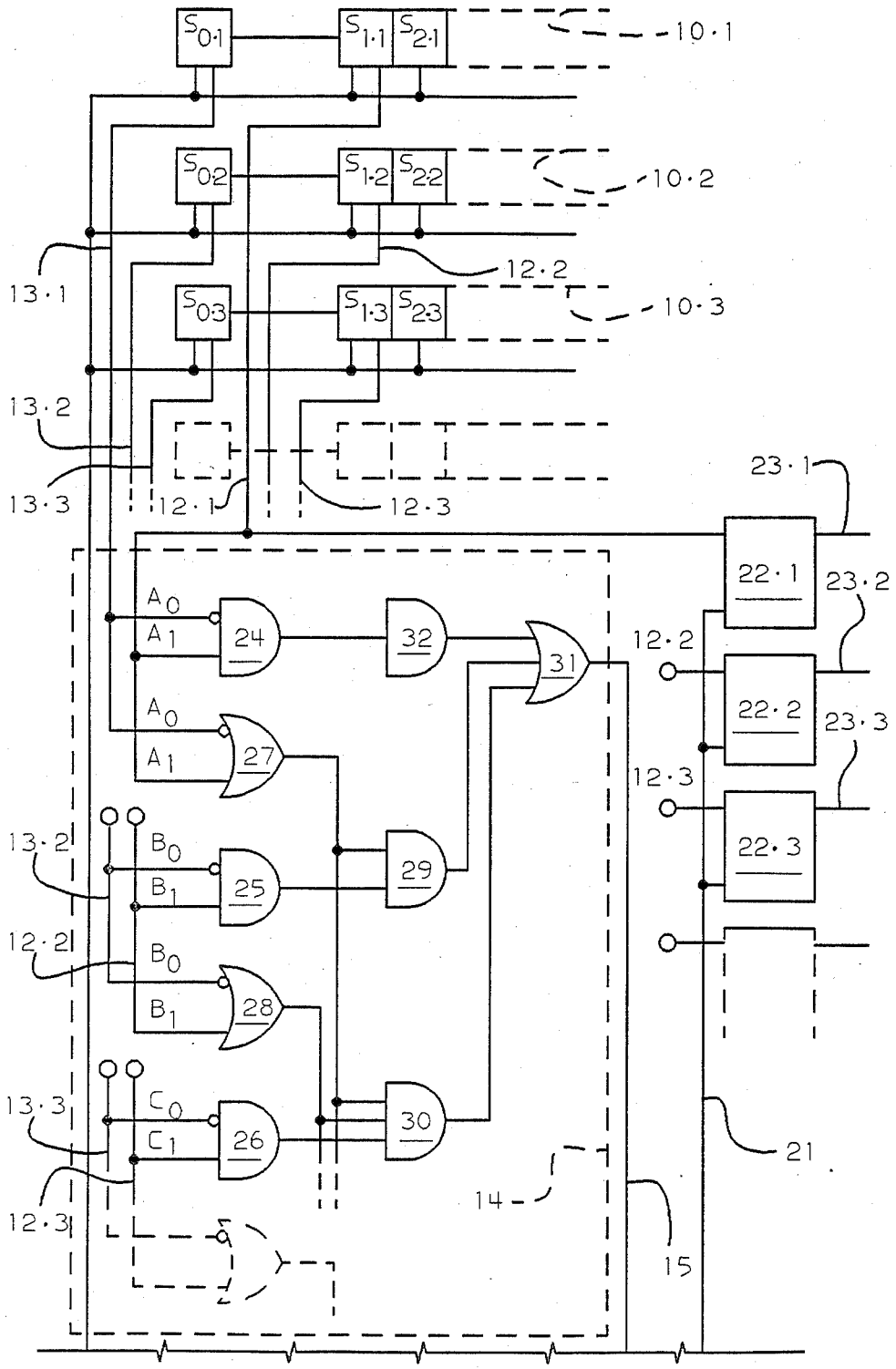
FIG. 6 shows an expansion of the circuit of FIG. 4 to enable it to function with multiple intensity CRT displays with additional details of the circuit blocks of FIG. 4.
Figure 6B:
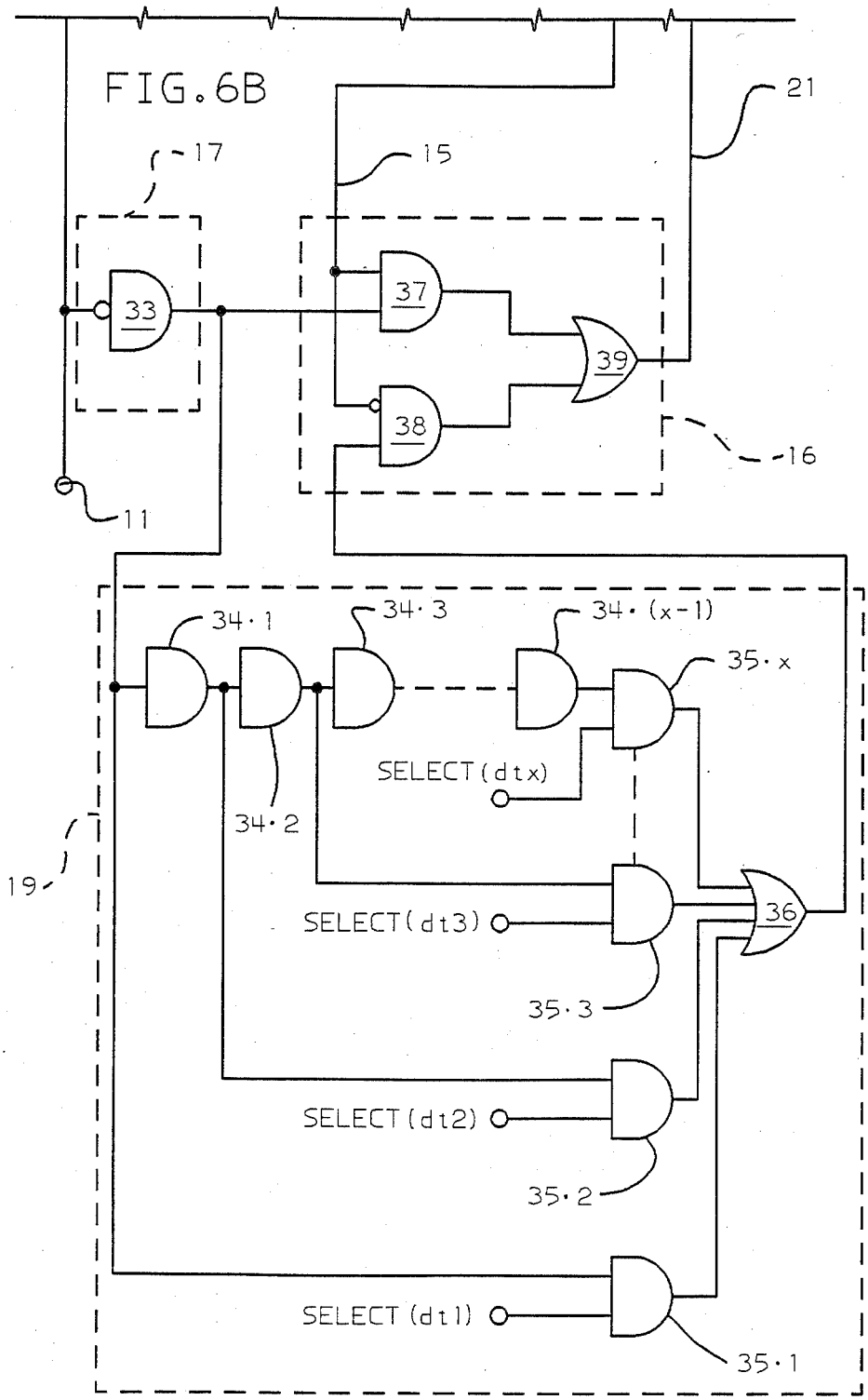

A comparator suitable for comparing two multi-bit binary values is shown in FIG. 6 within the dotted outline of block 14. The example selected for the purpose of illustration compares two three bit numbers A0, B0, C0 and A1, B1, C1 where A0 and A1 are the most significant bits. Further for the purposes of this example, it is assumed that the value A0, B0, C0 represents the intensity of the preceding pel of the pel data stream and is current held in the three extra stages S0.1, S0.2, S0.3 and the value A1, B1, C1 represent the intensity of the current pel of the data stream and is currently held in the three stages S1.1, S1.2, S1.3 of the three parallel shift registers 10.1, 10.2, 10.3.

Each corresponding bit value from the two numbers is applied simultaneously as inputs to comparator over lines 12.1, 12.2, 12.3 and 13.1, 13.2, 13.3 to each of three AND-gates (24, 25, 26) and to each of two OR-gates (27, 28). For the sake of clarity, portions of the connecting lines from shift register output stages to gate inputs have been omitted. The inputs to the gates receiving the bit values representing the preceding pel in stages S0.1, S0.2, S0.3 are all inverting inputs as designated by the small circles in the circuit diagram. With this arrangement of gates an up-level signal on the output of an AND-gate indicates that the bit value from the current pel PEL(N) is greater than the corresponding bit value from the preceding pel PEL(N−1). All other input conditions give a down-level output. Thus, an up-level signal from AND-gate 24 indicates the bit condition A1>A0, an up-level signal from AND-gate 25 indicates the bit condition B1>B0, and an up-level signal from AND-gate 26 indicates the bit condition C1>C0. Clearly, the signal level output from an OR-gate is the inverse of that of its associated AND-gate. Thus the only occasion where there is no output from an OR-gate (27 or 28) is when the current pel is brighter than the preceding pel that is PEL(N)>PEL(N−1). Should the comparison of the higher significant bits indicate that PEL(N) is brighter than PEL(N−1) then an output from the associated OR-gate (27 or 28) is used to inhibit further comparisons of lesser significant bits.

The output from the OR-gate 27 representing the result of comparison of the two most significant bits is applied as one input to a further AND-gate 29 which receives its second input from the AND-gate 25 comparing the second most significant bits B0 and B1. The output from OR-gate 27 is further applied as input to a 3 input AND-gate 30 which receives as its other two inputs the outputs from OR-gate 28 representing the result of comparison of the two second most significant bits B0 and B1, the outputs from the AND-gate 26 representing the result of comparison of the two least significant bits C0 and C1. The output from the three AND-gates 24, 29 and 30 are applied as inputs to a 3 input OR-gate 31. An up-level signal through OR-gate 31 from AND-gate 24, or from AND-gate 25 through OR-gate 29, or from AND-gate 28 through OR-gate 30 indicates the sought for condition of PEL(N)->PEL(N−1).

In summary if bit A1 >bit B1 an up-level signal is gated through AND-gate 24 and OR-gate 31 to output line 15 to multiplexor 16. Simultaneously, a down-level output from OR-gate 27 inhibits the results of comparisons of lesser significant bits being gated through AND-gates 29 and 30. If bit A1 <bit A0, then the OR-gate 27 output is at an up-level enabling one input of OR-gate 29. In the event that bit B1 >bit B0 then an up-level output from AND-gate 25 is gated through enabled AND-gate 29 and OR-gate 31 to output line 15. Should bit A1<bit A0 and bit B1<bit B0 then OR-gate 27 output and OR-gate 28 output are both at an up-level enabling two inputs of OR-gate 30. If bit C1>bit C0 then an up-level output from AND-gate 26 is gated through enabled AND-gate 30 and OR-gate 31 to output line 15. It is seen that by addition of further logic stages as shown in phantom outline in FIG. 6 this comparator can easily be extended to be operable to compare pel values in excess of 3 bits. Finally, in order to equalize signal transmission time through the circuit by the various different routes, an additional logic stage 32 is provided between the output of AND-gate 24 and the input of OR-gate 31.

As stated previously, the pel waveform in this embodiment is symmetrical in shape and a half-pel period phase shift is achieved simply by inversion. Clearly, a non-symmetrical waveform would require a different means of phase shifting. Accordingly, as shown in FIG. 6, the circuit within the dotted outline of block 17 to achieve the ½-pel period phase shift is represented by a simple inverter 33.

The small delay (dt) imparted to this ½-pel period phase shifted clock is provided by the pulse transmission delays provided by a number of series connected simple logic circuits. It has been found convenient to provide the means for selecting not just one value of delay (dt) but several different values dt1, dt2 . . . dtn, each individually selectable to suit the operating characteristics of the display system in which the circuit is to be employed. As shown within the dotted outline of block 19 the value of the delay is selected by tapping the signal at various points from the AND-gates 34.1, 34.2, 34.2, . . . 34.(x−1) connected in series. All gates are one-input gates. The tap connection from the input of each AND-gate 34.1, 34.2 . . . 34.(x−1) and additionally from the output of AND gate 34.(x−1) is taken as one input to an associated 2-input AND-gate 35.1, 35.2 . . . 35.x respectively. The other input to each two input AND-gate is the select input for that gate, operable by application of an up-level signal applied thereto, to select the associated delay value produced by the sum of the individual delays of the circuits preceding the selected gate. The outputs from the delay selecting AND-gates 35.1, 35.2 . . . 35.x are supplied as inputs to x-inputs to x-input OR-gate 36. The output from OR-gate 36 is the line 20 supplying the delayed phase shifted clock (DELAYED PEL CL) as one input to mutiplexor 16.

It is seen therefore that selection of gate 35.1 by energization of its SELECT (dt1) input delays the phase shifted pel clock waveform (PEL CL) by the shortest time, namely the sum of the transmission delays of the two logic units, namely 35.1 and 36. Selection of gate 35.2 by energization of its SELECT (dt2) input delays the phase shifted pel clock waveform by an amount equal to the sum of the transmission delays of three logic circuits, namely 34.1, 35.2 and 36. Selection of gate 35.3 delays the phase shifted pel clock waveform by the sum of the transmission delays of three logic units and so on. The maximum delay equal to the sum of the transmission delays of all the series connected input AND-gates 34.1, 34.2 . . . 34. (x−1), select AND-gate 35.x, and the OR-gate 36 is provided by energization of the SELECT (dtx) input to AND-gate 35.x.

The multiplexor shown in dotted outline 16 in FIG. 6 consists simply of two AND-gates 37 and 38. The nominal or ½-pel period phase shifted clock waveform from inverter 33 is applied as one input to AND-gate 37 and the delayed clock waveform from delay circuit 19 is applied as one input to AND-gate 38. The comparator output signal on line 15 is applied as the other input to AND-gate 37 and AND-gate 38. However, the second input of AND-gate 38 is an inverting input as indicated by the symbol in the representation of the circuit in FIG. 6. The output signal from one or other of the two AND-gates 37 and 38 is passed by OR-gate 39 to the output line 21. Thus, as can be seen by inspection, when the output on line 15 is at an up-level, the nominal ½-pel cycle phase shifted clock from inverter 33 is gated through OR-gate 39. When the output on line 15 is at a down-level, the same clock waveform delayed by an additional selected amount (dt1 to dtx) is gated through OR-gate 39 to output line 21.

The output clock waveform with re-timed clock transitions from OR-gate 39 is applied to the clock inputs of three latches 22.1, 22.2, 22.3 in parallel, each corresponding to the single latch 22 required for the bi-level embodiment described with reference to FIG. 4. The output lines 12.1, 12.2, 12.3 from the three corresponding shift register stages S1.1, S1.2, S1.3 are applied to the data input of the latches respectively. For the sake of clarity, portions of the connecting lines from the shift register outputs to the latch inputs have been omitted. Accordingly, with this arrangement the 3-bit binary values appearing in parallel each pel clock cycle in the last stages S1.1, S1.2, S1.3 of the shift registers are gated through the three latches onto output lines 23.1, 23.3, 23.3. The signal levels on this three line output bus represent the data for display by the display system with selected transition re-timed to compensate for video amplifier rise time distortion as described in detail hereinabove. In the event that a pel is represented by more than 3 bits, a corresponding number of output latched will be required as illustrated by the additional latch shown in dotted outline in the figure.

Thus, while the invention has been described with reference to preferred embodiments thereof, it will be understood by those skilled in the art that various changes in form and details may be made without departing from the scope of the invention.

We claim:

1. A video display system of the kind in which the brightness of consecutive image points on a screen of a raster scanned CRT is defined by the values of consecutive pels of a digital video drive waveform, each such pel comprising one bit or a plurality of video bits processed in parallel, and in which means is provided for extending the duration of selected pels in the video waveform in order at least partially to compensate for image distortion introduced by the finite video amplifier rise and fall times of the CRT, characterized in that said means for extending the duration comprises, comparator means for examining each pel in relation to its immediately preceding neighbor in order to detect a transition therebetween representing an increase in brightness value from the immediately preceding pel to the currently examined pel, and re-timing means for causing the advancement in time by a predetermined interval of any such transition in the video drive waveform relative to remaining transitions.

2. A system as claimed in claim 1, wherein said comparator means includes two successive stages of a shift register or the like, means operable to cause successive values of said digital video drive waveform to be advanced sequentially from one stage to the other through said two successive stages under timing control of a repetitive regular pel clock cycle waveform supplied thereto and a comparator connected to respective outputs from said two stages, operable continuously to compare the digital values of the pels contained therein and, whenever the condition occurs wherein the magnitude of the digital value of the pel in said other stage exceeds that of the pel in said one stage, to provide, substantially for the duration of the current pel clock cycle, an output indicative of the occurrence of that condition.

3. A system as claimed in claim 2, wherein said retiming means includes a pulse gating circuit operable each pel clock cycle in response to the value of the comparator output signal during the current pel clock cycle to gate therethrough either a clock pulse from a nominal clock waveform or a clock pulse from a phase shifted version of the nominal clock waveform where the amount of phase shift corresponds to said predetermined interval of time, the nominal clock waveform itself being a copy of the pel clock waveform phase-shifted so that it and its phase shifted version are both available to clock pel data during the current pel clock cycle.

4. A system as claimed in claim 3, wherein said clocking pulse from said nominal clock waveform occurs during each pel cycle earlier than the clock pulse from said phase shift version by said predetermined interval of time, and wherein said pulse gating circuit is operable in response to a comparator output signal indicating that the current pel is brighter than the immediately preceding pel to gate therethrough during the current pel clock cycle a clock pulse from the nominal clock waveform but is operable in response to a comparator output signal indicating that the current pel is not brighter than the immediately preceding pel to gate therethrough during the current pel clock cycle a clock pulse from the phase shifted version of the nominal clock waveform.

5. A system as claimed in claim 4, further including circuit means operable to gate pel values sequentially one per pel cycle from said one stage under timing control of the composite clock waveform constituting clock pulses from the nominal clock waveform and/or the delayed version of the nominal clock waveform output from said pulse gating circuit thereby producing a video drive waveform re-timed as aforesaid.

6. A system as claimed in claim 3, 4 or 5, wherein said re-timing means includes a pulse delay circuit constituting at least one logic circuit connected to receive said nominal clock waveform and wherein the output from said at least one logic circuit constitutes said phase-shifted version of said nominal clock waveform, the value of the predetermined interval of time being determined by the sum of the pulse transmission delays of the individual components of at least one logic circuit through which the nominal clock waveform is passed.

7. A system as claimed in claim 6, wherein said pulse delay circuit constitutes a plurality of logic circuits connected in series and including logic selection means operable to tap off the waveform output from any one of a number of tapping points through said series connected logic circuits, the tapping points being distributed throughout the series connected logic circuits so as to provide an output waveform phase-shifted by a time interval different to that of a waveform output from any other tapping point.

* * * * *